US006457624B1

(12) United States Patent
Weihrauch

(10) Patent No.: US 6,457,624 B1
(45) Date of Patent: Oct. 1, 2002

(54) DEVICE FOR DRIVING A FASTENING ELEMENT INTO A BASE AND USE OF SAID DEVICE

(75) Inventor: Achim Weihrauch, Blansingen (DE)

(73) Assignee: Futurtec AG, Rotkreuz (CH)

( * ) Notice: Subject to any disclaimer, the term of this patent is extended or adjusted under 35 U.S.C. 154(b) by 0 days.

(21) Appl. No.: 09/555,776

(22) PCT Filed: Nov. 23, 1998

(86) PCT No.: PCT/EP98/07555

§ 371 (c)(1),
(2), (4) Date: Jun. 2, 2000

(87) PCT Pub. No.: WO99/29472

PCT Pub. Date: Jun. 17, 1999

(30) Foreign Application Priority Data

Dec. 4, 1997 (CH) ..... 2798/97

(51) Int. Cl.[7] ..... B25C 1/04
(52) U.S. Cl. ..... 227/10; 173/211
(58) Field of Search ..... 227/10, 11, 9, 227/130; 173/210, 211

(56) References Cited

U.S. PATENT DOCUMENTS

| | | | | |
|---|---|---|---|---|
| 3,133,287 A | | 5/1964 | Kopf et al. | |
| 3,331,546 A | | 7/1967 | Brunelle | |
| 3,969,989 A | | 7/1976 | Maurer et al. | |
| 4,122,987 A | * | 10/1978 | Jochum et al. | 227/10 |
| 4,441,644 A | | 4/1984 | Farian | |
| 4,824,003 A | | 4/1989 | Almeras et al. | |
| 5,280,673 A | * | 1/1994 | Zieve et al. | 227/10 |
| 5,797,534 A | * | 8/1998 | Almeras et al. | 227/130 |
| 5,881,940 A | * | 3/1999 | Almeras et al. | 227/10 |
| 6,059,163 A | * | 5/2000 | Pfister et al. | 173/211 |
| 6,182,881 B1 | * | 2/2001 | Kellner et al. | 227/10 |

FOREIGN PATENT DOCUMENTS

| | | |
|---|---|---|
| DE | 19 08 735 A | 8/1970 |
| DE | 23 39 163 B | 6/1974 |
| DE | 26 32 413 A | 1/1978 |
| DE | 27 27 639 A | 1/1979 |
| EP | 0 661 140 A | 7/1995 |
| EP | 0 732 178 A | 9/1996 |

* cited by examiner

*Primary Examiner*—Scott A. Smith
(74) *Attorney, Agent, or Firm*—Scully, Scott, Murphy & Presser

(57) ABSTRACT

An apparatus for emplacing fastening elements into a placement base, for the purpose of fastening components. The apparatus includes a working piston, the acceleration and braking range of which, with optimal emplacement depth (31) and minimal piston length can be adapted to different conditions, and for use with mechanical, pyrotechnical, pneumatic, electromagnetic and electrothermal working piston drives.

27 Claims, 13 Drawing Sheets

DEVICE FOR DRIVING A FASTENING ELEMENT INTO A BASE AND USE OF SAID DEVICE

BACKGROUND OF THE INVENTION

1. Field of the Invention

Apparatus for emplacing a fastening element into a placement base, and use of the apparatus.

The invention relates to an apparatus for emplacing a fastening element into a placement base having a working piston for acting on the fastening element (4) upon emplacement, which piston includes a piston plate (11, 34) and a piston shaft (34) of a rigid, non-deformable material, the piston plate (11, 51) being displaceable in a piston guide sleeve (7) during a working stroke (31) out of a rest position into an end position and having in the working direction a ring-shaped stop surface (37) with respect to which there is arranged coaxially and at a spacing a ring-shaped counter-surface (43) of a receiving sleeve (38, 50) of a rigid, non-deformable material. The invention also pertains to a use of this apparatus for fastening components to the placement base with the aid of fastening elements.

2. Discussion of the Prior Art

There are known numerous apparatuses of this kind, which are employed for fastening the most varied components on placement bases of different kinds by means of fastening elements such as bolts, rivets, nails. Depending on configuration, the apparatuses work in single-shot operation, semi-automatically or fully automatically. Basically, all apparatuses are similarly constructed. A working piston is accelerated, mechanically or under the pressure of a medium, for example under pyrotechnically generated gas pressure. This working piston then drives for its part the actual fastening element. The apparatuses further have auxiliary devices which fulfil particular auxiliary functions or serve the reliability of their functioning or their handling. An example for such an auxiliary function is the return of the working piston after an emplacement procedure. Further auxiliary devices serve for example for the supply of the fastening elements and damping or buffering. Still further components such as for example housing parts fulfil functionally secondary purposes.

There is described in U.S. Pat. No. 4,441,644 an impact buffer for hammer apparatuses for hammering nails of the like, in which an impact piston, acted upon by compressed air, is guided in a cylinder and hammers the nail, located in the guide channel, into a placement base. The main inventive feature of this patent consists of the buffer system, of two buffer elements having differing geometries and materials, which in the case of blind shots, i.e. when inadvertently no nail is loaded, or in the case of energy excess due to an emplacement procedure in a placement basis of little resistance, is capable of absorbing this excess energy such that the apparatus or its functional parts remain undamaged and reliable even after multiple operations.

The functional process of the apparatus is as follows:

Upon actuation of a trigger arranged on the handgrip, compressed air flows into the cylinder chamber between the upper side of the impact piston and the guide cylinder. At a certain pressure the clamping connection between the head of the impact piston and a latching bush is released and the impact piston is moved by the compressed air out of its stand-by position into a braking position, whereby the nail is hammered into the placement base by means of the impact stroke. Upon impact of the impact piston on the first elastomeric buffer this is squashed, deformed and compressed. By these means there arises a certain spring path of a few mm, whereby excess energy is already exhausted to a great degree. In the case that further excess energy is present, the ring-shaped surface of the impact piston runs against a second elastomeric buffer which is located at the end of the guide cylinder. By means of this form fitting the impact piston is completely braked, there being attained an additional spring path of a few mm depending on the hardness and deformation of the second buffer element. After the impact procedure the impact piston is moved back into its stand-by position (rest position) again, by means of compressed air. A new nail can be loaded and the next impact procedure initiated. Disadvantageous with such an apparatus is the great spring path arising in the braking procedure, my means of which the apparatus is protected, but the placement accuracy is strongly affected. Differing braking procedures by the soft buffer system, due to differing nail lengths or fastening materials or placement bases lead to different depths of the nail heads in the fastening material (nail head flush or projecting or sunken).

A further compressed air driven impact apparatus is described in EP-A-661 140. The aim of this invention is to avoid a post-impacting of the impact piston or apparatus head, and wide area damage to the decorative fastening element caused thereby, due to the air compressed in front of the impact piston and the elastic receiving buffer. With this apparatus also the impact piston is softly braked via the receiving buffer form-fitting through elastic deformation with a certain spring path, and then is moved back into the initial position via air stored in a separate chamber.

Compressed air apparatuses of the kind described are employed primarily for driving nails into soft placement bases such as wood, i.e. the impact energy is relatively small. A further disadvantage is the connection of this kind of apparatus to stationary compressed air equipment via hose connections.

With harder placement bases such as concrete or steel, there are primarily employed bolt emplacement apparatuses having chemical/pyrotechnical drive by means of drive load cartridges, which thus allow free ranging fastening of bolts or nails.

The apparatus described in EP-A-732 178 can be considered as exemplary of such apparatuses. With this apparatus diverse configuration possibilities of modern apparatus developments are demonstrated, the technical features shown in the patent application being founded substantially on damping elements, braking elements and return springs of elastomeric materials.

The receiving procedure of the drive piston is effected relatively softly via the combined buffer and braking system due to the elastomeric properties of the component elements, the axial movement of the drive piston upon emplacement of a bolt or upon a blank shot being locally limited by means of the radial expansion of the braking element. The elastomeric compression spring provided for the piston return is thereby loaded to a high degree due to the dynamics of the emplacement procedure, whereby at least partial elements of the overall spring are taken to the blocking limit. Further, the spring path of the proposed return device is relatively small due to the specific properties of the selected construction having a plate structure and the material-specific properties of the elastomer, so that the structural length of the apparatus, in relation to a particular placement path (=bolt length) is considerable, Thereby, the bolt emplacement apparatus is relatively heavy and clumsy.

A further disadvantage consists in that the braking procedure of the drive piston in combination with the return spring and the braking buffer is undefined, since both the drive power, e.g. with different cartridges, and also the emplacement power, with different bolt lengths and different emplacement resistances (differing placement bases), strongly influence the overall braking and receiving procedure and thereby influence the quality of emplacement. Also, the elastomeric springs use a high percentage of the drive energy if they are strongly compressed for reason of a shorter structural length of the apparatus. This leads to a reduction of the emplacement performance of the apparatus.

A further possibility for piston return is shown in U.S. Pat. No. 3, 331,546. There, a plate-like arrangement of elastomeric plate springs is pressed together and compressed upon the advance of the drive piston, The full energy of the drive piston in the case of a blank shot, or the excess energy upon emplacement of bolts in a light placement base, must be taken up by the overall spring material. With regard top structural length, exactitude of emplacement depth and energy consumption, what is said above applies also to this apparatus.

DE-A-2 632 413 shows a bolt emplacement apparatus having and elastic damping packet which consists of a series of ring pairs arranged one behind another, Here, the application of the braking force of the drive piston is effected via a moveable braking ring, which upon advance of the drive piston is pressed against the damping packet by the gas pocket building up between piston head and receiving ring. The advantage of this arrangement lies in that, due to the relative movement of the receiving ring, the impact forces of the drive piston are reduced in the braking procedure. Drive piston, receiving ring and damping packet are thereby formfittingly connected.

A further braking and receiving system for a pyrotechnically driven drive piston is described in U.S. Pat. No. 4, 824,003. There, the buffer system consists of a conical braking ring into which the drive piston head runs formfittingly with its likewise conical part. Arranged after this braking ring is a ring-shaped arrangement of two parts which are elastically and plastically deformable. Thereby, the drive piston can be received in a defined manner and the excess emplacement energy absorbed by the braking system. An automatic piston return is not provided with this apparatus. Conical receiving and braking systems achieve, with the relatively high running velocities of the drive piston, very high surface compressions, since due to the manufacturing tolerances of the two conical surfaces, naturally, the entire conical surface never corresponds in a form-fitting manner, rather only a small partial region. There thus arise local overloads upon form- fitting together, which lead to material damage of the drive piston or braking ring due to plastic deformation.

SUMMARY OF THE INVENTION

The object of the present invention is seen in the, provision of an apparatus of the kind mentioned in the introduction, which is so conceived that it not only optimally fulfils the basic functions but also various auxiliary functions, and is so conceived that numerous variants in the configuration and use of the apparatus are possible; and proposal of a use of the this apparatus.

BRIEF DESCRIPTION OF THE DRAWINGS

This object is achieved by means of the features of the characterizing part of claim 1, or claim 23. Advantageous further developments and preferred exemplary embodiments of the apparatus in accordance with the invention are defined by means of the claims dependent upon claim 1.

The principle of the invention and of the advantages achieved thereby will be described below in detail with reference to examples and with reference to the drawings; thereby, not only the invention but also basic theories of emplacement technology and the state of the art will be explained. There is shown.

DETAILED DESCRIPTION OF PREFERRED EMBODIMENTS

At this point, attention is directed to the fact that components arranged in the various apparatuses, which fulfil corresponding functions, are provided in part with different reference signs depending upon the apparatus, and that not all components are provided with reference signs for every apparatus.

Figure 1:
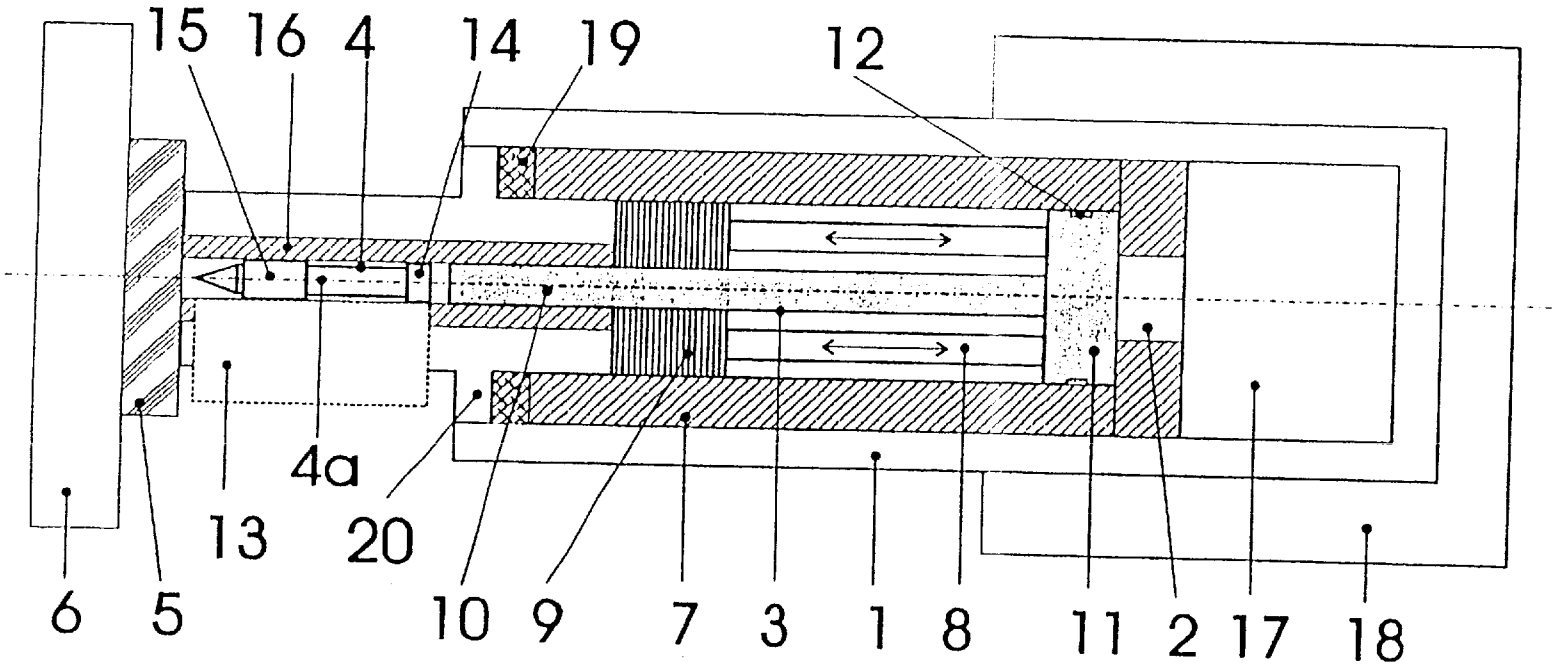
FIG. 1 a conventional apparatus with its main components, in simplified, schematic illustration.

FIG. 1 shows the main components of a conventional apparatus. In a housing 1, a working piston 3 is accelerated by means of a drive medium 2. This working piston 3 drives a fastening element 4, for example a nail or bolt, to be emplaced, into the placement base 6, either through or for a component 5 to be fastened, which is to be fastened by means of the fastening element 4 on the placement base 6. The working piston 3 moves in a piston guide sleeve 7. The return of the working piston 3 is effected by means of a return device 8. The impact of the working piston 3 takes place on a damping device 9, which also serves as stroke restriction. The working piston 3 has a piston shaft 10 and a piston plate 11. The sealing with regard to be chamber 2 acted upon by medium, behind the piston plate 11, is effected by means of a sealing element 12. The fastening element 4 to be emplaced consists substantially of a bolt shaft 4, a bolt floor 14 and a guide region 15. An auxiliary device serves as a bolt magazine 13. The piston shaft 10 and the fastening element 4 run in a shaft guide sleeve 16. The control is effected via a control device 17. A housing 18 forms a secondary component. A damping element 19 is located between the piston guide sleeve 7 and a positioning sleeve 20.

Performance determining properties of such apparatuses are the working piston power and the piston working path or working piston stroke. The working piston power is primarily determined by means of the mass of the working piston $m_k$ and the piston velocity $V_k$. The piston energy $E_k$and the piston momentum $I_k$ are transferred to the fastening element and to the housing upon acceleration of the working piston and by the placement procedure. The piston energy $E_k$ and the piston momentum $I_k$ can be calculated as follows:

$$E_k=m_k/2v_k^2$$

$$I_k=m_kv_k$$

The properties of the fastening element—always supposing sufficient stability of shape upon the emplacement procedure-can be described or defined by means of the desired penetration depth into the placement base and by means of the kind of the emplacement channel. If one assumes that in order to displace a volume element V in the placement base the necessary kinetic energy E remains constant as a first approximation—in terminal ballistics this prediction has found wide consideration as the so-called Cranz's model law—there are provided by the relationship $$E/V=k$$

where k is a constant, the most important criteria for the emplacement performance and therefrom fundamental considerations for the apparatuses. In the following, this will be explained on the basis of a simple example.

If, with a predetermined design of the bolt, one sets a particular emplacement depth, the required kinetic energy of the working piston can be estimated for example in accordance with the theory of Richter, which has been further developed in the ISL. This theory was developed for penetrating rigid cores of different tip or ogive shapes, and takes into account, along with the material strength, also inertial and frictional forces; the theory, originally proposed for homogeneous targets, was extended to targets having multilayer arrangements, with regard to which attention is directed to the ISL report R 120/83 "An armour formula for non-deformable ogive shots and its extension to deformable projectiles" by K. Hoog. The theory is concerned with the analytical treatment of terminal ballistic questions with non-deformable penetrators. With an emplacement depth of 10 millimetres into a placement base of structural steel and a bolt having a diameter of 4 mm and having a tip in the form of an ogive, there applies, in the case that this ogive is slim, the following relationship:

$$E/V\approx 2.$$

Thus, for the emplacement of the bolt, an energy of 0.25 kJ is needed. This energy can be made available for example by an apparatus having a mass of bolt and working piston of 0.1 kg with a velocity of 72 m/s or by a twice as large mass of bolt and working piston of 0.2 kg, with a velocity of about 50 m/s. According to the Richter theory, with constant energy, the depth performance increases with decreasing impact velocity, by about 20 per cent if the impact velocity in accordance with the above-mentioned example is reduced from 72 m/s to 50 m/s; therefore, as a consequence of the lesser energy requirement for the emplacement depth considered, with the lesser impact velocity, the latter need not be 50 m/s but only about 40 m/s. These relationships must be taken into account in the design of the apparatuses with regard to the mass of the working piston and the velocity. The corresponding considerations are also of significance because together with a possible bending, which will be considered further below, it can be shown that a critical, apparatus-specific velocity must not be exceeded or that with the design of the apparatus the limits for the dynamic parameters are set.

In connection with the question of an advantageous piston velocity with a predetermined piston energy, there should also be taken into account the interaction between working piston and the surrounding apparatus. For this there serves the following consideration; with a mass ratio of piston to housing of 1 to 10 or a piston mass of the 0.1 kg and a housing mass of 1 kg, and with a piston velocity of the 30 m/s, there is yielded from the fact of equal momentum of piston and housing, a recoil velocity of the housing after acceleration of the working piston of 3 m/s. The kinetic energy of the piston is 45 J, the kinetic energy of the housing 4.5 J, and the sum of the kinetic energy is, consequently, 49.5 J. The ratio of the kinetic energy of the piston to the total kinetic energy is 49/4.5 or almost 11. If the piston mass is now increased to 0.2 kg and at the same time the housing Mass is reduced to 0.9 kg, so that the total mass is not altered, there is thus provided— if the total energy is to remain the same and taking into consideration that the momentum of piston and housing must be the same—a piston velocity of 20 m/s and a recoil velocity of the housing of 4.5 m/s. The kinetic energy of the piston is a thereby 40.5 J and that of the housing 9 J. This corresponds now to a ratio of the kinetic energy of the piston to the overall kinetic energy of 49.5/9 or about 5.5. This means that with a doubling of the mass of the working piston from 0.1 kg to 0.2 kg the energy transferred to the housing as recoil energy is doubled, namely from about 10 per cent of the overall energy to about 20 per cent of the overall energy.

The above consideration of energy speaks for a higher piston velocity, in contrast to the above-explained theory of Richter, in accordance with which a lower piston velocity is to be preferred. Further, in practice, with a change of the piston mass due to constructional considerations there is to be reckoned with significantly less mass differences between working piston and housing than with the above mentioned mass differences, so that the ratio of the energy of working piston and housing is solely about 3 per cent to 5 per cent less favourable when the piston velocity reduces. Thereby the terminal ballistic arguments in accordance with the theory of Richter carry more weight in favour of a rather lower piston velocity. Further there are also the observations concerning bending and the allowable material stresses, which both likewise limit the piston velocity. These considerations also show that through the mass or energy distribution influence can be had on the impact loading of the housing.

The treatment of apparatus-and materials-specific questions and the corresponding calculations can generally be carried out best for materials whose mechanical-dynamical behaviour can be described for example by means of analytical relationships. Much more complex, and correspondingly also more difficult to treat or to calculate, are emplacement procedures with which the fastening elements or bolts are emplaced into inhomogeneous and non-metallic placement bases such as for example concrete, in particular reinforced concrete, concrete with inclusions of stones, porous and brittle or hard materials, and multi-layer constructions. A further, technically demanding problem in the emplacement of the fastening elements or bolts then arises if the component to be fastened, for example shuttering, insulation material or metal plate, differs strongly from the placement base in terms of construction and mechanical properties.

From the above outline of the problems it is clearly necessary that the main components of the apparatus, namely the working piston unit, must be so conceived and configured that it can deal with the different conditions of use which arise. Further, the working piston unit must, without alteration of the concept, or by means of relatively simple changes to the individual components, be able to be adapted optimally to different requirements. The above requirements are underlined in that changing safety regulations are also to be complied with.

Emplacement performance, reliable functioning with differing combinations of materials and of predetermined emplacement depths to be complied with are, together with the capability of variation of the individual apparatus components, the decisive requirements for a technically optimal solution.

A particular problem with the previously known apparatuses consists in the necessary braking of the working piston. In the treatment of this problem a distinction must be made between emplacement procedures in which fastening elements are actually emplaced, and emplacement procedures in which no fastening elements are emplaced; the latter are dreaded by apparatus manufacturers and are designated as blank shots. Such blank shots appear for example if, upon the firing of the apparatus, no fastening element which can be emplaced is present, or if the provided placement base is a hollow space, for example a gap, or has a hollow space. In the emplacement procedure, as is known, a certain part of the piston energy or of the piston momentum is transferred to the fastening element and to the placement base. The braking of the working piston and the compliance with a particular emplacement depth play a role here. With blank shots, the entire piston energy has be compensated in the apparatus itself. This leads as a rule to peak loadings in the affected components of the apparatus and thus requires corresponding damping devices or the provision of piston brakes.

In manually operated apparatuses these damping problems have a great significance; their solution requires a technically balanced interaction of the individual components of the apparatus with the goal that avoidable external forces do not appear or the load profile is optimised. With apparatuses which are not intended for manual operation this requirement is less significant. Thereby, however, it is to be taken into account that when largely going without damping devices or elements, the stresses in the individual components of the apparatuses increase, which is to be taken into account in their design.

The present invention takes into account not only the above-mentioned theoretical considerations but also all viewpoints relevant in relation to a realisation of the apparatuses. This means that the new apparatus, with regard to the structural region of the working piston, not only satisfies in optimal manner all technical requirements in relation to this region, but also allows in any respect a variation which is as large as possible of optional configuration variants. Thus, the new apparatus can be optimised for example with regard to the drive, which may be mechanical, pyrotechnical, pneumatic or electric. Further, the new apparatus can be manufactured with a minimal apparatus structural length which has not previously been realized, which is determined in practice only by the desired emplacement depth. Further, the new apparatus has a structural conception which permits the most varied apparatus configurations; it can be manufactured as a manually operated apparatus and also has an apparatus for extreme requirements or in accordance with a very particular requirements; for example there can be mentioned use as a heavy load apparatus, for example for the emplacement of larger fastening elements in steel constructions or use in industrial robots or also in particularly light or miniaturised configurations.

A further requirement, very important for the configuration of the apparatuses, is their robustness in use.

Likewise it is desired that apparatuses which function without fault can be produced, without use having to be made of highly specialised materials. These are confined mostly to very restricted fields of use, with correspondingly slight margin of safety, are cost intensive, often only available with difficultly over a long period of time, difficult in processing and also frequently problematic in combination with other materials. An attractive, universally usable and at the same time economic solution requires that the individual components need a minimum of mechanical preparation and that complex material treatments and surface working should be largely avoided.

In the case of automatically working apparatuses, the return of the working piston after each emplacement procedure must be ensured. For this purpose, a series of methods are known, which extend from the exhaust gas piston return (Hilti) to mechanical spring elements, to return springs of elastomeric material (Würth). Systems with exhaust gas returns are technically relatively complicated and restricted in their field of use and in their functional reliability. They also require for example an acceleration medium with gas generation. Further, the return process in the case of a disruption of functioning or in the limit is difficult to ensure. With metallic and with elastomeric return springs it is to be ensured that they do not extract too much energy from the working stroke and thereby adversely influence the emplacement power in relation to the energy employed. Metal springs must, moreover, not be exposed to accelerations which are too high, since with dynamic loading the mechanical properties of the materials are subject to limits. Elastomeric or rubber-like return elements having buffer functions also influence the structural length of a system and require a relatively large functional volume. Further they restrict, as do devices with exhaust gas returns, the freedom of design.

Basically it is the case that return devices or return elements must function reliably, should have a small mass, in order to avoid inertial forces and negative influences on the emplacement procedure, must only be loaded mechanically by themselves, should only bring about the relatively slight return forces, require a small structural volume and be able to be adapted in simple manner to technical alterations, for example in the case of modifications of individual elements.

For the apparatus type to which the known apparatus illustrated in FIG. 1 belongs, there are known a series of possibilities for the damping or for the path limiting of the working piston 3 and also for the damping of the overall apparatus. The piston damping is effected with the previously known solutions for example via a frictional clamping between the damping and stroke limiting device 9 and the piston shaft 10, in accordance with Hilti, or also by means of axial buffering, for example by means of cones—solution in accordance with Kellner/Würth, whereby the energy or the momentum of the working piston 3 is transferred via the return spring 8 to the damping or stroke limiting device 9. This restricts the freedom of design of the return spring 8 decisively and also leads to impermissible loadings in the damping and stroke restricting device 9 and in the piston shaft 10 in the case of a power excess of the working piston, such as appears for example in the case of blank shots. With clamping of the piston rod 10 by means of the damping and stroke restricting device 9 no defined braking takes place. Further, such friction related procedures are fundamentally non-uniform or are subject to grave variations during the passage of use time and for example also due to the surface properties.

Figure 2:
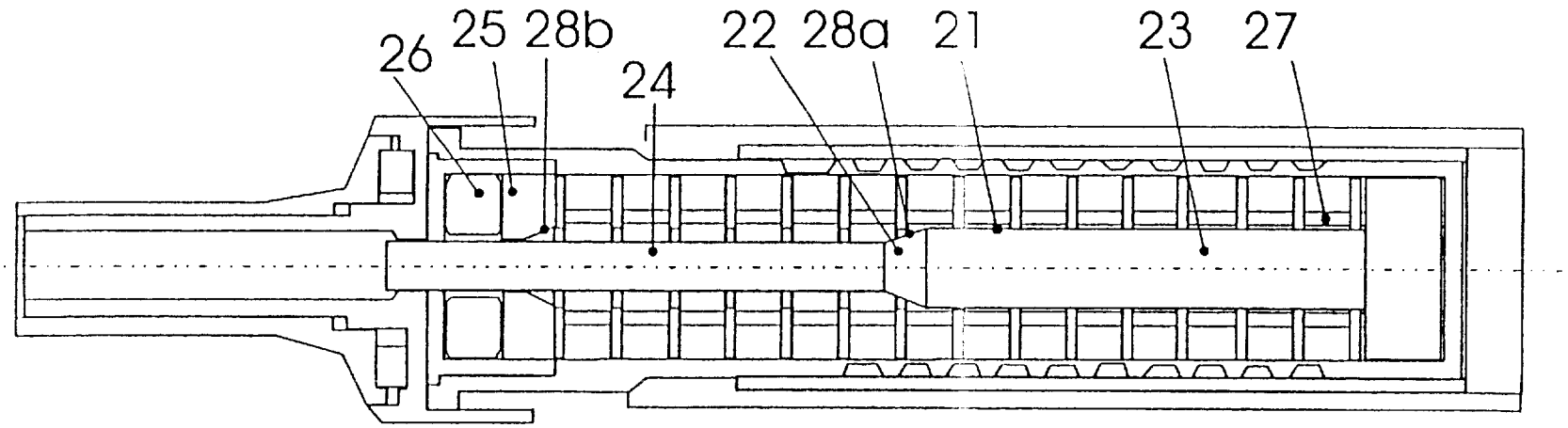
FIG. 2 a further conventional apparatus.

FIG. 2 goes in somewhat more detail into the solution of the damping problem according to Kellner/Würth, which corresponds to the present state of the art. Significant elements in this apparatus are the path limiting of the working piston 21 by means of a piston rod-cone 22 and an elastomeric return spring 27. For braking the working piston 21, the piston rod-cone 22 is placed into a conical ring-like element 25. This conical ring-like element 25 is a buffered via a buffer element 26. The opening angle 28*a* or 28*b* determines the radial and axial components of the piston energy. The surface of the piston rod-cone 22 is yielded from the relationship of the diameter of the rear piston rod part 23 and forward piston rod part 24. Thereby it is clear that the cone surface, decisive for the material loading, cannot be arbitrary altered or enlarged: on the one hand it is positioned in the vicinity of the axis, a change of radius thus has little effect with regard to the area. The smallest possible diameter of the forward piston rod part 24 is determined by the demands upon emplacement of the fastening element. The diameter of the rearward piston part 23 cannot be arbitrarily increased, since otherwise the remaining working volume for a return element 27 would be too small. With this design it is unavoidable that the piston sleeve is relatively long.

If greater opening angles 28*a* or 28*b* are selected, the cone surface of the piston rod-cone 22 is smaller, which has the consequence that the loading of the material rapidly exceeds the permissable stresses. With small opening angles 28*a* and 28*b* the radial components of the piston energy increase. This has the consequence of large pressure stresses in the piston rod-cone 22. The comparatively high radial components in the conical ring-like element 25 there lead to higher tensile loadings. Overall it is the case that with such a solution an adaptation or optimisations of the decisive parameters, with the provided more widely extended working range of the apparatus, is only possible to a limited degree.

Basically, the return of the working piston by means of an elastic element such as a rubber spring represents a technically interesting solution. Such a solution has, however, two disadvantages. First there are provided thereby long piston rods 21, since behind the piston rod-cone 22, due to the function of the return element 27, there must be located a piston rod part 23 corresponding to the necessary piston path; the working piston is however the most critical element of the apparatus with regard to the loading; therewith also the length of the piston rod is always a decisive criterion. Second, the working piston is also a critical element also in the case of higher energy excess or in the case of blank shots, in particular the position at the transition to the forward, thinner piston part 24. These critical positions, in particular with dynamic loadings, make it necessary to employ for the entire working piston high quality materials, so that the working piston forms a very demanding and costly component. Corresponding observations apply also to the conical ring-like element 25. In summary, for this solution it is the case that the configuration of the working piston with a piston rod cone, in combination with the conical ring-like element, makes more difficult an optimal configuration and permits a variation of the apparatus configuration only to a restricted extent.

It is of particular significance to so configure the working piston that is has sufficient security against deflection, since even very slight axis deviations of the working piston lead to failure of the apparatus, due to the dynamics of the emplacement procedure. In the dynamic loading of thin bodies, with regard to security against bending, a distinction is to be made between static and dynamic bending problems. For static bending problems, a corresponding bending loading can be calculated in accordance with Euler. Dynamic bending problems occur primarily with components which are highly dynamic and loaded impact-wise and lead to so-called dynamic-plastic bending. Here, attention is directed to ISL report RT 13/70 of the study "Investigations of plastic bending of thin metal cylinders upon impact on metallic targets" by G. Weihrauch et al. In contrast to static or Euler bending, in dynamic-plastic bending, the length or the slimness of the body plays a role, since the dynamic bending procedure takes place between the impact surface and the spreading plastic front. According to experimental investigations, with impact velocities of thin very strong bodies on hard targets of about 100 m/s it can be assumed that—so far as the plasticity limit is not exceeded—bending problems can be treated in accordance with Euler.

In the acceleration of fastening elements, two regions are present in the apparatus at which bending can preferentially occur, namely first the region between piston plate and the forward guide in the placement head, and second in the region between the forward guide in the placement head and the fastening element, or bolt or nail.

Further, bending also occurs in the fastening element itself, that is in the bolt or nail. The bending mentioned secondly above, in the region between the forward guide in the placement head and the fastening element is a very complex, since the free part of the advancing bolt shaft becomes continuously longer upon emplacement; the mentioned bending must therefore be considered in particular upon impact of the fastening element and during the emplacement procedure together with this fastening element.

By means of analytical methods there can thus be made only a few basic estimations, more exact observations are to be carried out with three dimensional FE calculations, since, with lateral movements, axis symmetric arrangements are no longer involved.

In the estimation of the bending load in accordance with Euler, it is as a first approximation assumed that with the bending problems mentioned firstly and secondly above, a mixture of two kinds of bending is involved, namely on the one hand a bending with free rod ends, guided in the axis, and on the other hand a bending with one fixed and one freely movably rod end, so that the so-called free bending length lies between 1 and 2. The stress arising in the components, considered as rod, is calculated as:

$$\delta = E\ \pi/4(r/L)^2$$

whereby E is the modulus of elasticity, r the radius and L the length of the rod. For a ratio of length to diameter of 10, or correspondingly of length to radius of 20, there is yielded for example as limit for the appearance of static bending, a stress of about 1300 N/mm$^2$.

The stress induced in the fastening element or the bolt upon impact of the working piston thereon is determined in general in accordance with the following equation $$\delta = v(E\rho)^{1/2}$$

whereby E is the modulus of elasticity, v the impact velocity, and ρ the density. From this equation there is provided the velocity v at which the limit stress is reached for a particular material. For the selected example this is about 35 m/s. If one takes into account that for working piston materials of high strengths, for example 1500 N/mm$^2$ is employed, and that with dynamic procedures with higher limit stresses calculation can be made whereby in the present case the limit stresses may be higher by a factor of 1.5, there is thus yielded a velocity of about 60 m/s. With higher velocities of the forward piston shaft or of the fastening element, the elasticity limit is exceeded and local flow effects appear. Further, bending in accordance with Euler is to be expected.

The above estimation is of basic significance for the design of the apparatuses. In particular it emphasizes that the free length of the working piston should be kept as short as possible. This is of importance in connection with a central impacting of the bolt/nail of importance. Further, for the avoidance of critical stresses, the velocity should not be selected to be too high. This means that the necessary emplacement performance can be set by the variation of other means, e.g. via the piston mass.

Figure 3A:
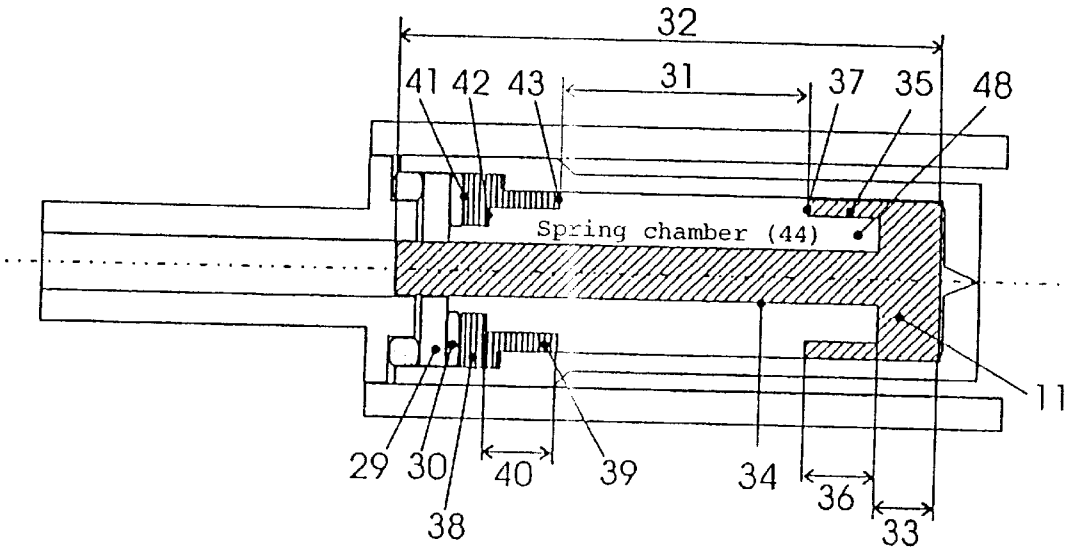
FIG. 3A an apparatus in accordance with the invention, having a working piston in its initial disposition, that is, before the working stroke.
Figure 3B:
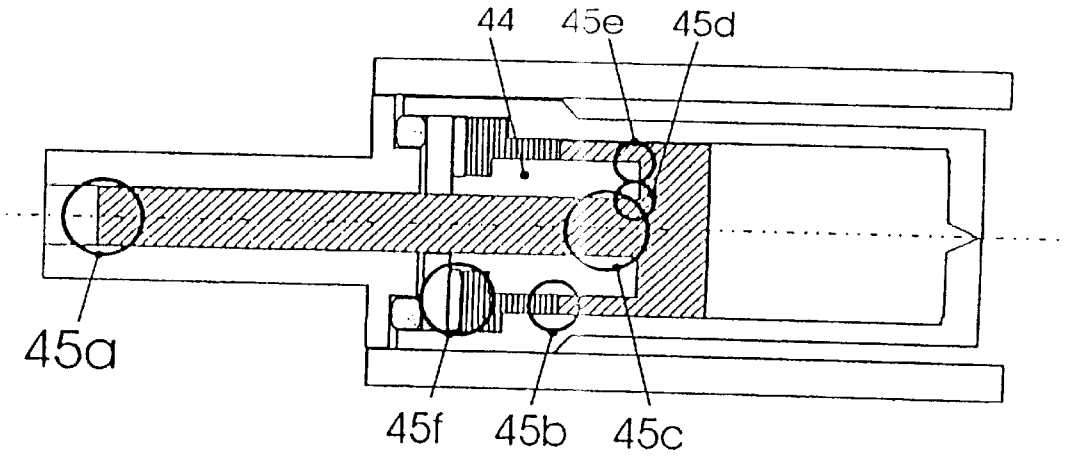
FIG. 3B the apparatus illustrated in FIG. 3A, with the working piston in its end disposition, that is, after the working stroke and before the return.

FIGS. 3A and 3B show schematically the configuration of the region of the working piston for an apparatus for the emplacement of fastening elements in accordance with the invention. The thus conceived new apparatus combines within itself a series of advantages with which not only are the above explained problems largely solved, but also there is ensured a high level of possibilities for constructionally diverse variants. In FIG. 3A there are illustrated the main features of this concept. They consist in that for the limiting of the working stroke 31 there is provided a stroke limiting device effective on the piston plate 11. This is so configured that an impact surface is arranged on the piston plate 11 which in the end disposition of the piston, that is after the working stroke, comes to bear upon a counter-surface arranged on the cylinder.

The impact surface may be formed by means of the forward end surface 37 of a piston sleeve 35. The counter-surface 43 may be formed by means of the end surface towards the piston plate 11, of a receiving sleeve 38 connected with a ring element 39. Thereby it is possible to provide only the piston sleeve 35, only the ring element 39 with the receiving sleeve 38 or a combination of piston sleeve 35 and ring element 39/receiving sleeve 38. The receiving sleeve may also be formed in the manner of a web.

By means of this arrangement a chamber is formed which serves as spring chamber 44, in which the return device can be located. This return device 8 is, in the emplacement procedure and in the case of a blank shot, subject only to its self-loading. The impact transferred to the piston sleeve 35 or the ring element 38 has effect via a carrier ring 29 which for its part, if necessary, can be impact buffered with respect to the housing by means of the damping element.

In the following, without any claim to completeness, the advantages of the new apparatus are listed:

the length of the piston shaft 34 is minimal.

the construction is adapted to the various return action possibilities. Thus, due to the spring chamber 44, which can be altered within wide limits, not only all mechanical return devices, for example metal springs or elastomeric systems, but also other return devices, for example with drive medium, in particular gas, are possible.

The concept is fundamentally suitable for various kinds of drive of the working piston, in particular also for an electromagnetic or electrothermal drive.

The piston velocity can, with constant primary energy, be varied within wide limits by variation of the piston mass.

The dimensioning can be adapted to the materials employed; corrections, for example due to altered performance requirements, are thereby relatively easily possibly.

The piston shaft 34 may be as stiff as desired.

The piston plate 11 together with the piston sleeve 35, provides an extremely stiff constructional element.

Piston guiding and piston sealing in the region of the piston plate 11 can be advantageously effected.

By means of alteration of the diameter of the piston shaft 10 or of the mass of the working piston, through alteration of the dimensions and/or the selection of materials with other densities, the performance of the apparatus can be varied, with the same drive, which is a particularly important point with regard to use of the apparatuses. Therewith, the details of the constructional configuration can be adapted to the terminal ballistic conditions of the emplacement procedure.

Piston shaft 10 or 34 and piston plate 11 may be separate components. Thereby there is possible for these two components a separate optimization, for example with regard to surface treatment, material, mass and dimensions. With a purely cylindrical configuration of the shaft there can be employed for example materials which to attain particular mechanical properties, for example a high resistance to breaking, must be subject to special treatments which are only possible with cylindrical bodies, for example a cold hardening by hammering. Thus, inter alia, there are already available nitrogen alloy steels with the dimensions in question here, having strengths of up to nearly 3000 N/mm$^2$.

Different piston shafts can be combined with diverse piston plates.

In the highly loaded regions, which are indicated in FIG. 3B by circles, multi-gradient materials can be employed; thereby materials are involved in which for example the mechanical properties, for example the hardness, change between predetermined limit values in one direction, thus for example in the axial or radial direction of the completed body, as a rule however, not in two orthogonal directions.

The concept can be adapted to different requirements for placement depths and emplacement performance, in optimal manner. Thus, due to the short piston rods and their high stiffness, not only can very great emplacement depths be realized but also very high emplacement forces can be mastered.

Only few surfaces need to be treated in a high-value manner. These can be effected particularly simply.

By means of the above explained possibilities of variation in the region of the working piston the apparatus can be optimized also with regard to external forces, for example with regard to shape and size of loading upon emplacement.

The concept is optimally suited to the given conditions, since the necessary return forces are relatively slight. This is a consequence solely of the piston mass, which for example with apparatuses for hand operation may lay between 50 and 300 grams. The return device must thus primarily ensure a sufficiently rapid and reliable return, and ensure the fixing of the piston in the initial position. The range of employment is, in accordance with the possibilities afforded by means of the invention, to be extended to miniaturized apparatuses with dynamically moved masses in the gram range, for example through the employment of high strength non-metallic components also or in particular with the components subject to dynamic loading, as far as heavy or massive apparatuses for special requirements, for example if very great impact or hammer forces are necessary.

The piston shaft can be provided with a bore, for example for receiving a signal line or an auxiliary mechanical device. Thereby, there can for example be considered, via an inner rod, to start a further function during or after the actual emplacement procedure. A hollow piston can also receive an inner or secondary piston, as is illustrated in FIG. 11.

In FIG. 3B the working piston is shown in its forwardmost disposition. The impact surface of the piston sleeve 35 and the counter-surface of the receiving sleeve 38 lay on one another so that the piston sleeve 35 together with the ring element 39 of the receiving sleeve 38 form the spring chamber 44, here closed, which accommodates the return device, for example a return spring or other return elements.

Calculation by means of simulation computations, which can be carried out 2-dimensionally for rotationally symmetric parts and, for estimation of the dynamic loading, can be carried out also 3-dimensionally with asymmetric parts, and were carried out at ISL at the suggestion of the inventor, for the purposes of orientation, have not only confirmed the above considerations relating to bending and to the demands on material with regard to the velocities arising, but have also shown that with the emplacement procedure itself, that is upon impact of the working piston upon the fastening element to be emplaced and the driving forward of the same, just as with braking and in particular with blank shots, impact-like loadings appear which determine the dynamic behaviour of the components involved and also determine the occurring or permissable demands on materials. Further, for example through the superimposition of impacts, locally high stresses may appear, as far as exceeding the flow limit, which can be avoided by means of structural measures. It is an advantage of the new apparatus that such measures are particularly simply possibly due to the possibilities for variation of the individual components.

The dynamically highly loaded zones are, as already mentioned, circled in FIG. 3B. There are involved:

The end surface of the working piston 45*a* driving the fastening element or the bolt;

the impact and counter-surfaces meeting together in the region 45*b*;

the zone 45*c*, tensile loaded in particular in the case of a blank shot due to the inertia of the piston shaft 34;

the transition region 45*d* between piston shaft 34 and piston plate 11;

the transition region 45*e* between piston plate 11 and piston sleeve 35;

the transition zone 45*f* between the forward sleeve surface 41 and the sleeve buffer 30 or between the sleeve buffer and the ring 29.

Figure 4A:
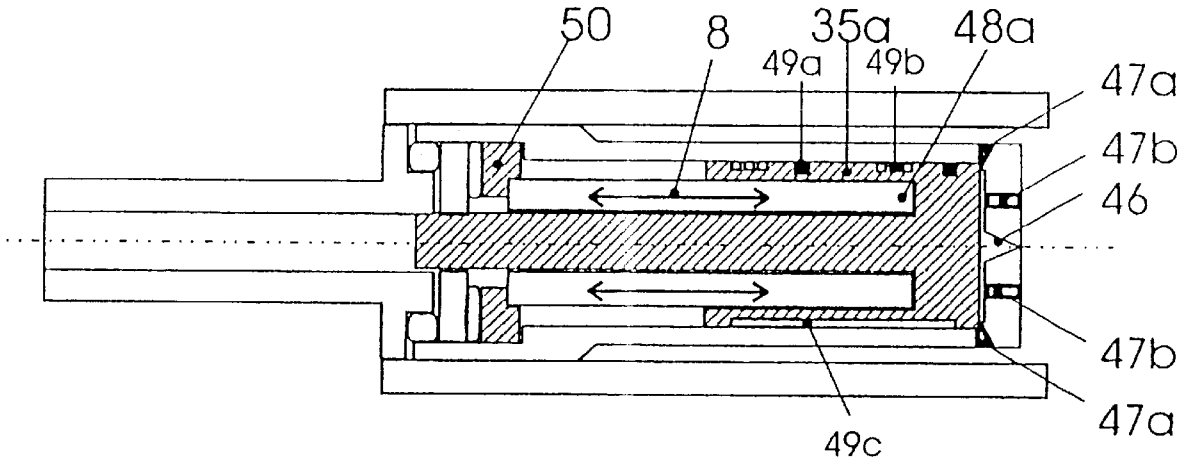
FIGS. 4A and 4B two apparatuses with variants of the stroke limiting in accordance with the invention.
Figure 4B:
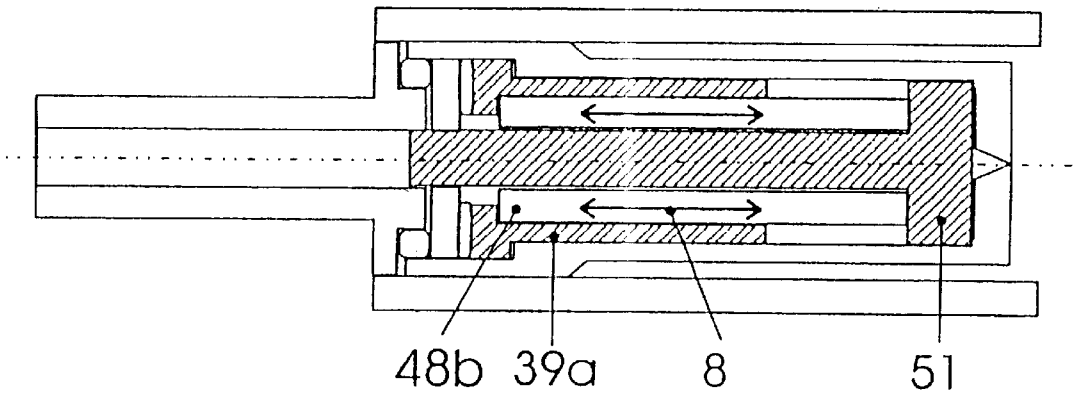

FIGS. 4A and 4B show a return device 8 which is indicated by means of an arrow, containing zone 48A or chamber 48B, in two limit cases. In accordance with FIG. 4A, the zone 48*a* is formed solely by means of a long piston sleeve 35*a*; in accordance with FIG. 4B the chamber 48*b* is provided solely by means of a long receiving sleeve 39*a*. In the first case in accordance with FIG. 4A, the counter-ring 50 is correspondingly flat, and in the second case in accordance with FIG. 4B the piston plate 51.

In FIG. 4A there are also illustrated examples for the supply of a working medium, for example a working gas. Along with the usual, central supply 46, the supply may also however be effected via passages 47*a* distributed on the periphery or via a plurality of bores 47*b*.

Likewise illustrated in FIG. 4A are examples of various sealings in the region of the working piston, with respect to the media chamber, which are necessary with the employment of fluid drive means. Thereby there may be involved for example a ring seal 49*a* or a labyrinth seal 49*b*, which are illustrated by way of example in the upper half of FIG. 4A; long piston sleeves are advantageously only guided at their ends, as is illustrated in the lower half of FIG. 4A; hereby, due to the hollow chamber 49*c* a special sealing element can be omitted.

As already repeatedly mentioned, the limiting of the stroke 31 of the working piston, illustrated in FIG. 3A, is to be given particular attention in the case of higher emplacement performance and in the case of damping with blank shots. With regard to the damping, a distinction must made between the damping for the moved components and the damping for the other components such as for example the housing.

The damping of the moved components can be effected via the piston sleeve 38, which takes up the remaining energy of the working piston, by means damping devices in the piston plate 11;

via the elasticity of the materials of the receiving sleeve 38 and of the piston sleeve 35;

in part via the return device 8;

by means of direct placement of the surface 37 of the piston sleeve 35 on the ring 29 or directly on the inner surface of the piston sleeve 7 or on the positioning sleeve 20.

Further, damping elements can also be provided both in the region of the receiving sleeve 38 and also of the piston plate 11 or of the piston sleeve 35, by means of vulcanisation.

The damping in the region of the housing surrounding the working region can be influenced by means of a particular relationship between moved masses to be subject to braking and rest mass;

by means of special damping devices on the housing, preferably elastomeric elements.

By means of the "filling ratio", there can for example, due to the particular dynamic properties of rubber, be selected any desired damping function with a rubber damper in combination with the element to be damped, by means of material and shape, up to a "hard impact" behaviour in the case of a full filling.

A technically particularly attractive variant, at the same time of interest due to its simplicity, is represented by the case that no particular damping measures are provided. The forces arising must then be taken up solely by means of constructional measures and material properties. By means of a modular structure and the particular features of the invention the employment of materials having extreme properties with regard to design, density and loadability is possible. This will be explained by means of the following examples;

- the receiving sleeve 38 consists entirely or partially of heavy or hard metal, ceramics, light metal or fibre-reinforced materials, corresponding to the properties hard, heavy, light, damping;
- the piston shaft 38 consists, possible only in the region towards the bolt, of hard metal or ceramics, corresponding to the properties hard, light;
- the piston plate contains elements for example of fibre-glass reinforced materials, corresponding to the properties light, damping;
- in the piston plate 11 a vulcanisation layer is introduced;
- the piston shaft 34 is mounted in an impact damping manner in the piston plate 11;
- the receiving sleeve 38, the piston shaft 34 or the piston plate 11 with the piston sleeve 35 is of a multigradient material.

In particular with greater diameters both of the moved and of the non-moved parts it can be of advantage to employ materials of lesser density, such as light metal, fibre-reinforced plastics or moldable ceramics. Constructional solutions are also conceivable with which the bodies are hollow and in case of need are combined for example with foamed metals as combination of a light manner of construction with a high stiffness.

By means of the possible two-part configuration of piston shaft 34 and piston plate 11, the piston plate 11 can be manufactured by casting processes. This is particularly advantageous with non-rotationally symmetric shapes or a more complex configuration of piston plate 11 and piston sleeve 35 in connection with the piston shaft 34. The connection between piston plate 11 and piston shaft 34 may be releasable or non-releasable and realized for example by means of threading, soldering, gluing, vulcanisation, frictional welding, boundary surface sintering, clamping or shrinkage.

FIGS. 5A to 5E show examples of apparatuses having mechanical return devices or return elements.

Figure 5A:
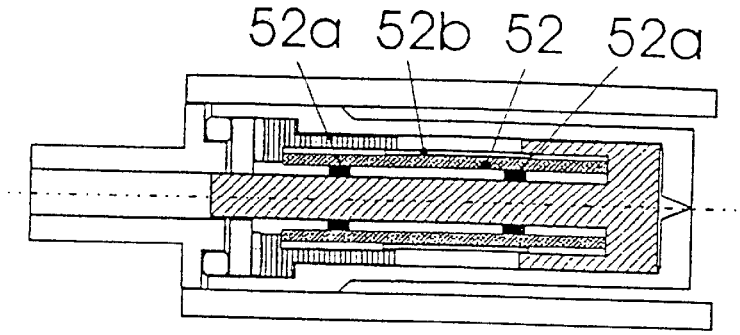
FIGS. 5A to FIG. 5F a plurality of apparatuses with various configurations of mechanical return devices.

In accordance with FIG. 5A the return elements involve a simple rubber sleeve or a hose 52, consisting for example of a homogeneous elastomeric material or of foamed material. By more elongate configurations for greater piston strokes, corresponding guides 52*a* must be provided. Such simple arrangements are suitable only for relatively short working strokes 31. It must also be ensured, for example by means of the configuration of the spring chamber, that the movement of the piston sleeve 35 is effected without disruption. For this purpose, a contribution can be made for example by a thin sleeve 52*b*.

Figure 5B:
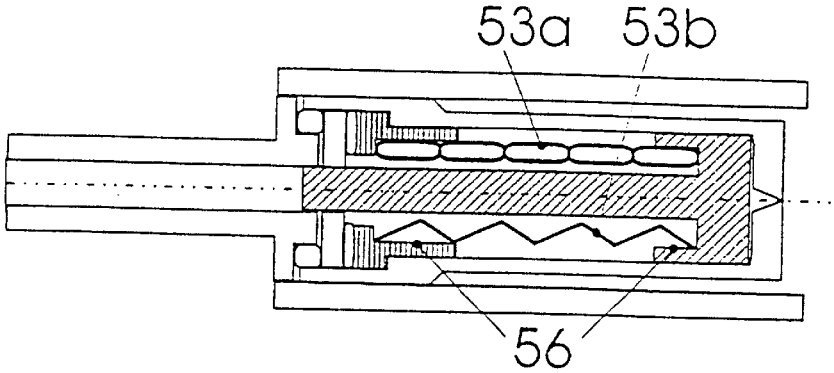

In accordance with FIG. 5B, the return element consists either of a system having rubber hollow chambers 53*a*, as is illustrated in the upper half of FIG. 5B, or of a bellows-like element 53*b*, as is illustrated in the lower half of FIG. 5B.

Figure 5C:
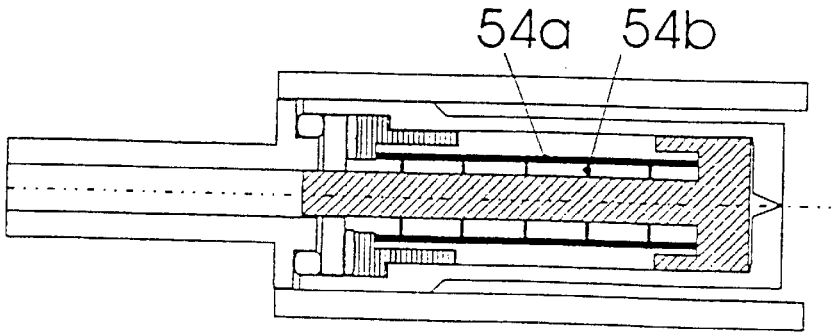

FIG. 5C contains a return device corresponding to that of FIG. 2, without, however, the rubber spring 54*a* having to apply a braking effect or a force for stroke limiting. The rings, or disks 54*b* serve here as fixing elements.

Figure 5D:
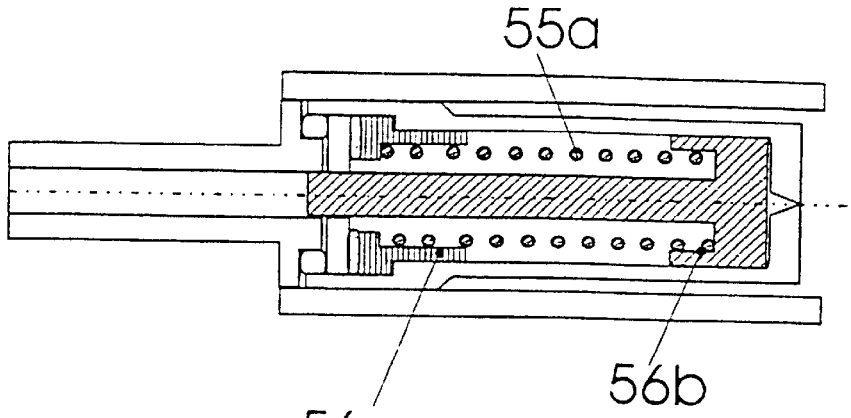

In accordance with FIG. 5D, the return device is a metal spiral spring 55*a*.

Figure 5E:
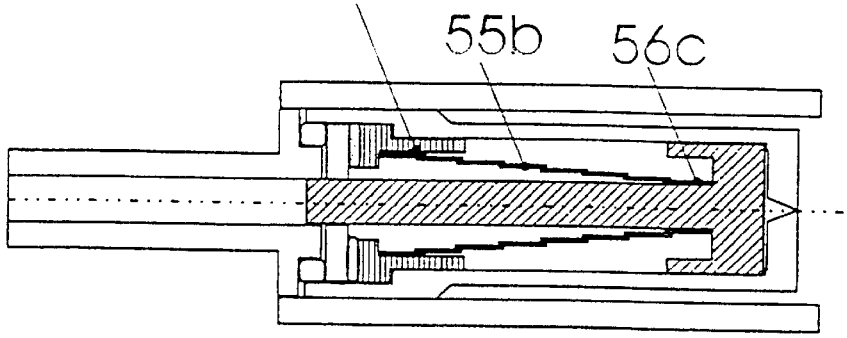

In accordance with FIG. 5E, the return device is formed by means of a metal spring having quadrilateral cross-section/flat section/flat wire 55*b*. The metal springs are fixed by means of the surfaces 56*a*, 56*b* or 56*c*.

Figure 5F:
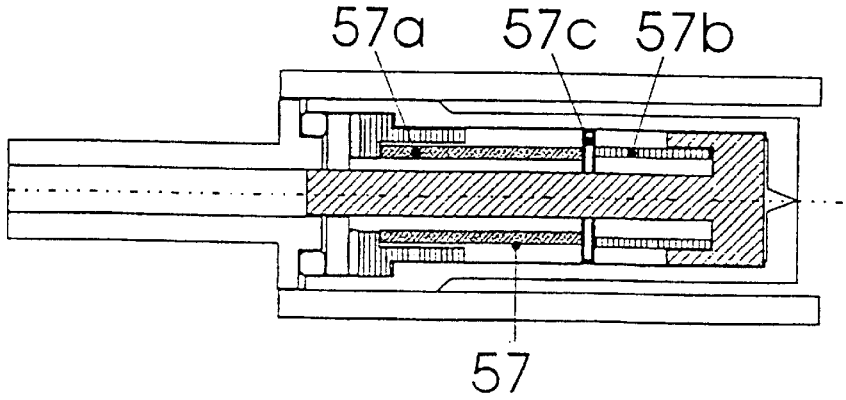

In FIG. 5F there is shown an example for multi-stage or multi-part return devices. There is involved a combination of a head or sleeve-side element 57*a*, a piston plate-side element 57*b* and a separating element 57*c*. This element can also serve as buffer between the end surfaces 37 and 43.

Figure 6:
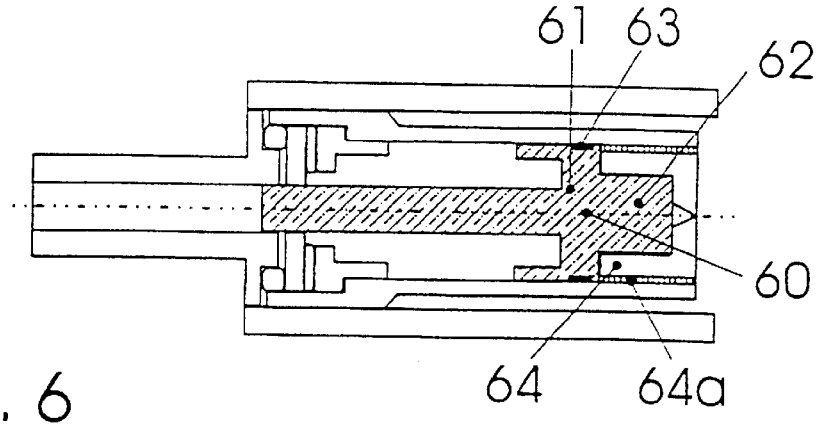
FIG. 6 an apparatus with a piston plate formed as a stepped plate.

FIG. 6 shows, as an example for a particular configuration of the piston plate, a stepped plate 60 which is made up of a forward piston plate part 61 and a rearward piston plate part 62. The piston chamber or piston guide sleeve 64 for receiving this stepped plate 60 is correspondingly adapted. This configuration is advantageous when for example a load alteration during the working stroke is to be attained. The outer region of the forward piston plate part 61 then assumes, expediently, the duties of guiding and of media sealing 63. In this way, there can be basically effected a constructional separation between the driven piston part and the guided or damped or returned part. The rearward part of the piston chamber sleeve or piston guide sleeve 64 is here suitable in particular manner in order for example to receive an adjustment device 64*a* for the alteration of the initial chamber volume.

Figure 7A:
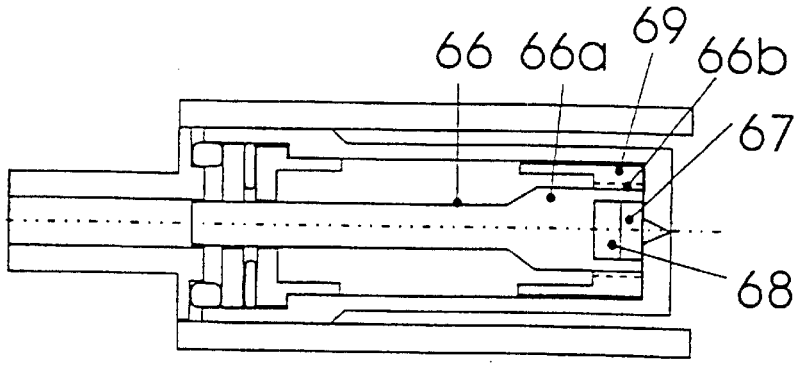
FIGS. 7A and 7B apparatuses with reinforcements of the piston shaft in the region of the fastening of the piston plate.
Figure 7B:
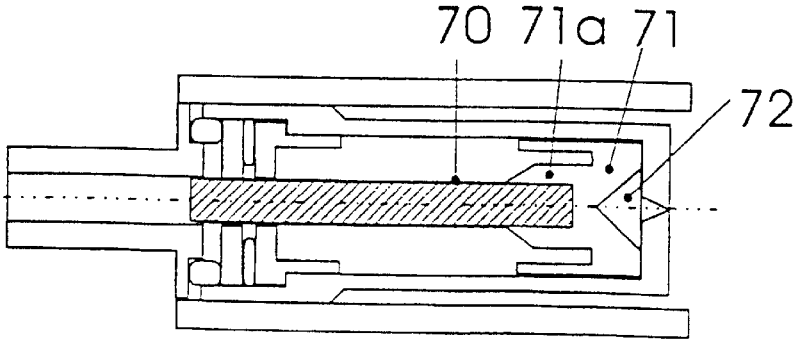

In FIGS. 7A and 7B there are illustrated apparatuses with possible reinforcements of the piston shafts in the region of the piston plate. This concept is suitable to take up the increased dynamic stresses arising in the transition region between piston plate and piston shaft, with regard to which attention is also directed also to FIG. 3B with the zones 45*c*, 45*d* and 45*e* there illustrated.

In accordance with FIG. 7A, the diameter of the shaft 66 increases towards the rear. The rearward piston shaft part 66*a* is connected for example by means of a thread 66*b* with the correspondingly configured piston plate 69. The piston plate 69 and the piston shaft 66 or the rearward piston shaft 66*a* may thereby be so configured that the rearward piston shaft part 66*a* extends through the piston plate 69 or is only placed into the piston plate 69. The through-going piston shaft part 66*a* of this example contains, on the side of the drive fluid, a bore 67 for media supply. Its volume can be altered by means of a screwed-in element 68.

FIG. 7B shows a working piston having a cylindrical piston shaft 70 placed into the piston plate 71, which cylindrical piston shaft is mounted in a corresponding piston shaft receiver 71*a* in the piston plate 71. The connection between the piston shaft 70 and the piston shaft receiver 71*a* can be effected for example by means of threading, soldering or shrinkage. With this example, the piston plate 71 has a recess 72, for example in the form of a turned-in part for media supply or for alteration of the original media volume.

Figure 8:
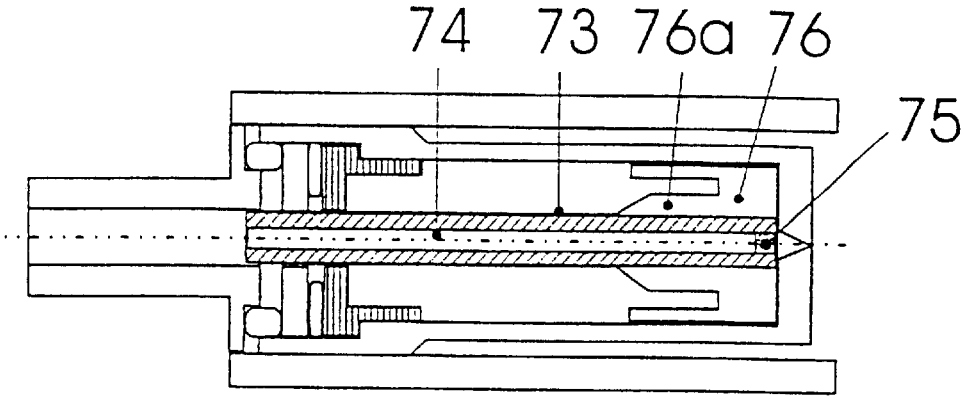
FIG. 8 a variant of the apparatus illustrated in FIG. 3A, having a working piston in a special configuration.

FIG. 8 shows a working piston for an apparatus according to FIG. 3, having a through-going piston shaft 73. The piston shaft 73 is purely cylindrical and thereby has the simplest possible shape. There can also be applied a bore 74 in the piston shaft 73 which in case of need can be closed with respect to the media chamber with a plug 75. Such a bore may serve inter alia also to direct medium through the shaft 73 onto the fastening element to be emplaced. The piston plate 76 and its region for the piston shaft receiver or piston shaft guide 76*a* are correspondingly configured.

Figure 9:
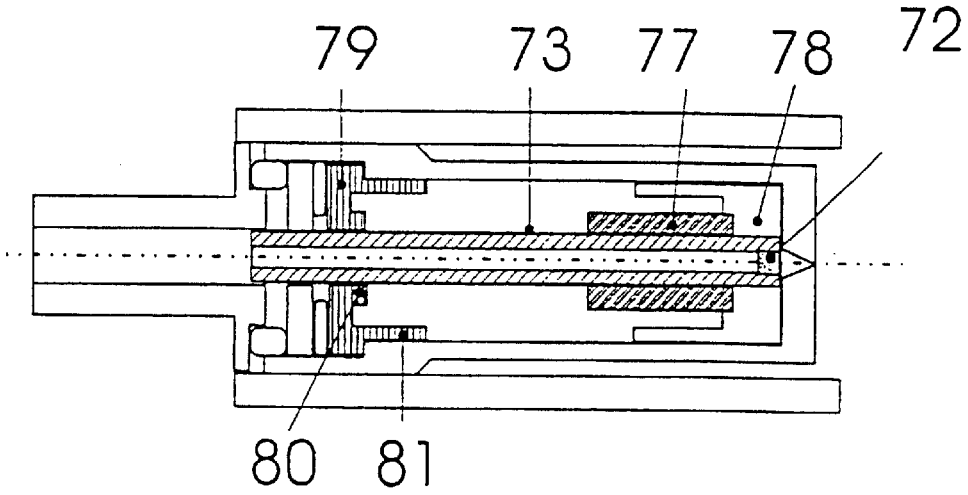
FIG. 9 a further variant of the apparatus illustrated in FIG. 3A, having a working piston in a further, special configuration.

FIG. 9 shows a working piston for an apparatus according to FIG. 3, which possesses a separate ring element 77 in the region of the piston plate 78. This can for example reinforce the piston shaft in this region or also serve for alteration of the piston mass. Further, it can serve as a special damping element upon impact on the inner web 80 of the correspondingly adapted receiving sleeve 79. In this way, for example, the emplacement procedure in the region of the piston sleeve 78 and of the outer web 81 of the receiving sleeve 79 and the combination of ring element 77 and inner web 80 of the receiving sleeve 79 can be effected in temporally differentiated manner.

From the above exemplary explanations it will be apparent that with the new apparatus the working piston, with the possibilities for variation thereof, represents the central component of the apparatus. Particularly important is its division into a shaft region and a piston plate region. Only this division affords the already explained constructional and material freedoms which make possible an optimal adaptation to the load situations involved.

In FIGS. 10A to 10E there are illustrated some examples relating to the variation of the working stroke 31 or the emplacement depth. The emplacement depth or the working stroke 31 can for example be varied

Figure 10A:
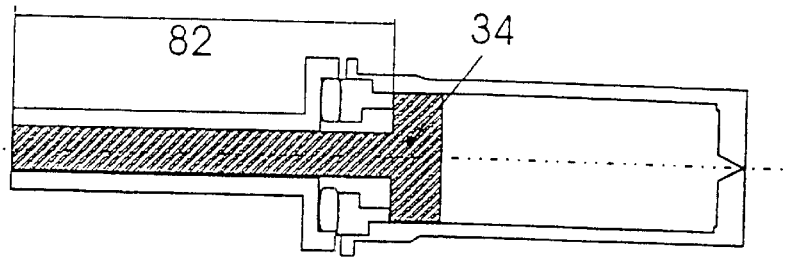
FIGS. 10A to 10E apparatuses with constructive possibilities for altering the working stroke of the working piston.
Figure 10B:
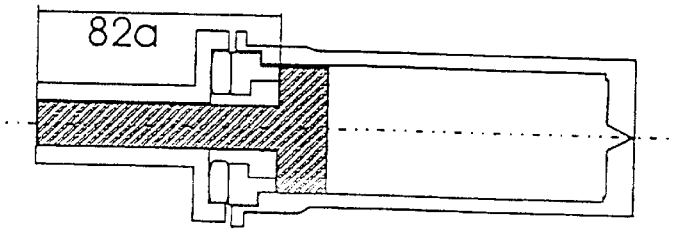
Figure 10C:
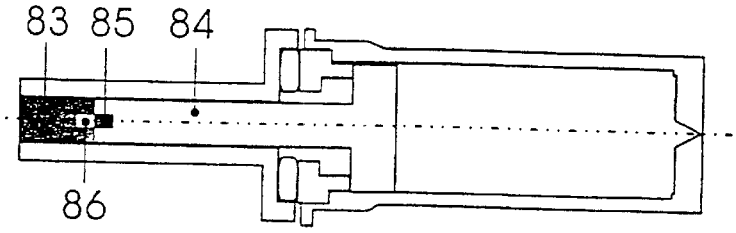
Figure 10D:
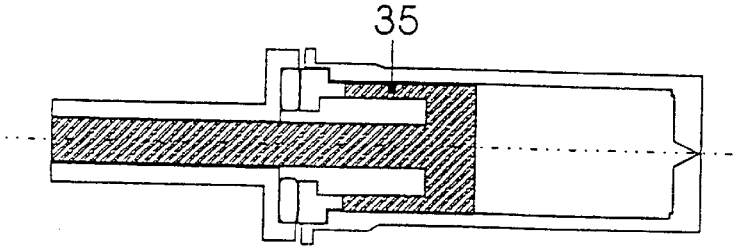
Figure 10E:
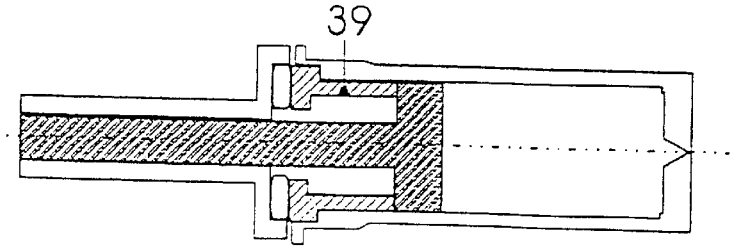

- through the alteration of the length of the overall working piston;
- through the selection of piston shafts of different lengths, with regard to which attention is directed to the corresponding illustrations of FIGS. 7, 8, 10A and 10B;
- by means of shaft extensions 83 of different lengths, which are either fixedly connected with the piston shaft 84, for example soldered, glued or mechanically connected, or are exchangeable and for this purpose pinned, threaded via a pin 85 of the shaft extension 83 or a pin 86 of the piston shaft 84, in which connection attention is directed to FIG. 10C;
- through alteration of the length of the piston sleeve 35, in connection with which attention is directed to FIG. 10D;
- through alteration of the length of the sleeve web 39 or the receiving sleeve, in connection with which attention is directed to FIG. 10E;
- by means of different installation depths of the piston shaft 70 in the piston plate 71, in the case of sufficient height of the piston plate, in connection with which attention is directed for example to FIG. 7B;
- through suitable combinations of the above-mentioned individual possibilities.

Figure 11A:
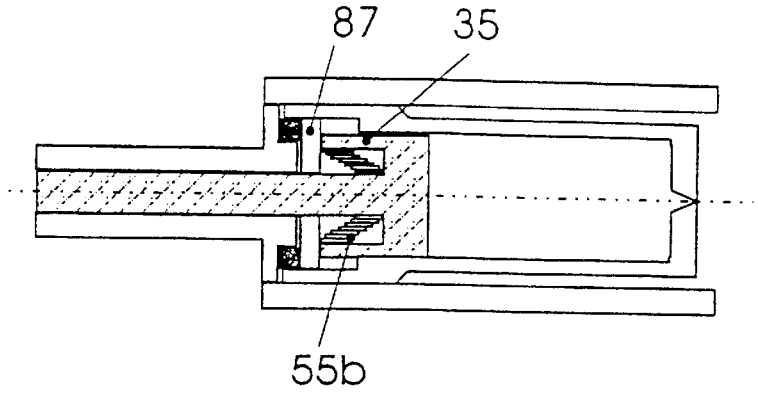
FIG. 11A to FIG. 11C three apparatuses with exemplary embodiments of the arrangement of the return spring according to FIG. 5E.
Figure 11B:
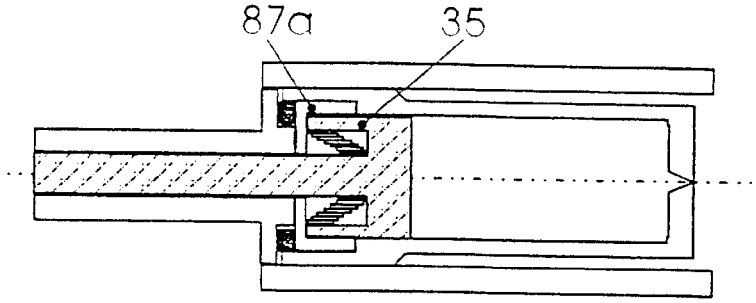
Figure 11C:
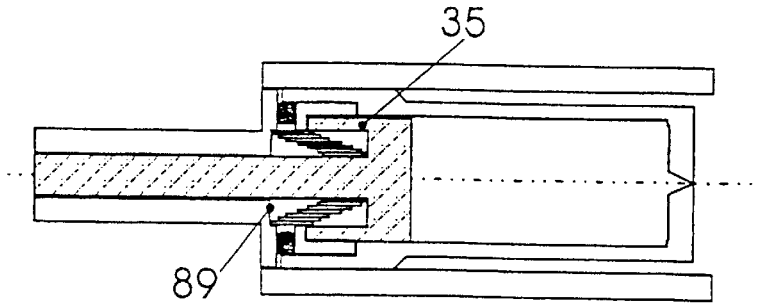

For a series of possible applications of the new apparatus it can be assumed, with the principle here proposed, that a damping, even with blank shots, can be omitted. In this case, the constructional length of the working piston unit is reduced to a minimum. In FIG. 11A to FIG. 11C there are illustrated corresponding configurations of the apparatus. In accordance with FIG. 11A, the piston sleeve 35 sits directly on a ring 87, following which there is solely a damping member for the apparatus 19, as is illustrated in FIG. 1. As spring element, there is here arranged a flat wire spring in the spring chamber 55*b*, in connection with which attention is directed to FIG. 5*e*.

FIG. 11B shows a further variant of the new apparatus. Here, the piston sleeve 35 sits directly on the forward bounding surface of the piston chamber 87*a*.

For increasing the working stroke, with predetermined length of the piston sleeve 35, the ring 87 can be omitted and the forward end surface of the spring element 55*b* moved correspondingly further forwardly, by means of direct sitting on the positioning sleeve 89, in connection with which attention is directed to FIG. 11C.

Figure 12A:
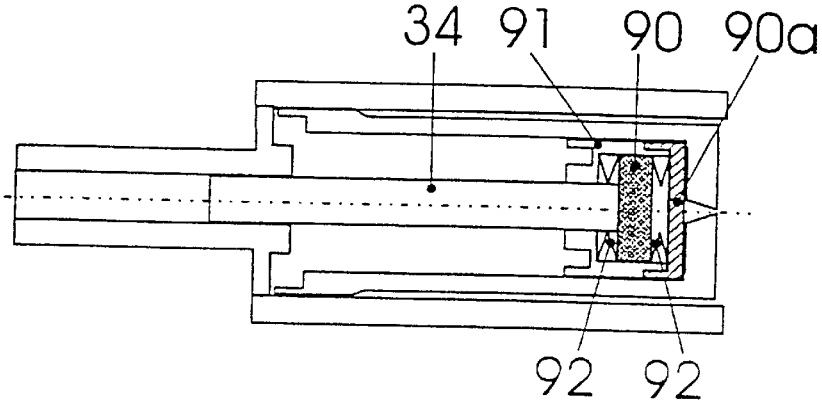
FIG. 12A and FIG. 12B two exemplary embodiments of the apparatuses with working pistons having damping.
Figure 12B:
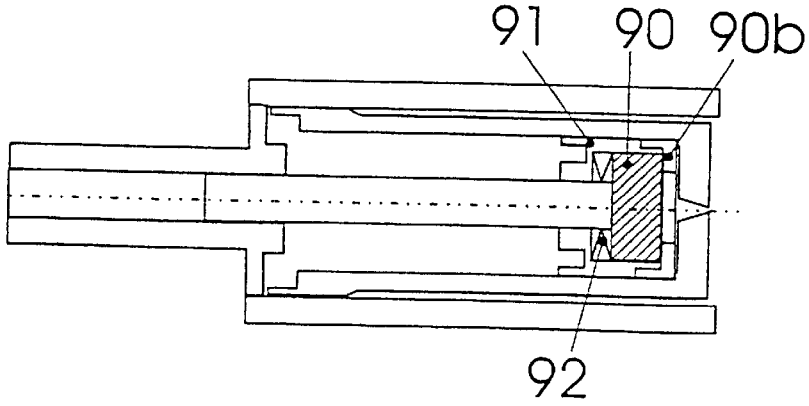

It is fundamentally also conceivable that the piston shaft 34 is mounted in a sprung manner via an inner piston plate 90 in a correspondingly configured outer piston plate 91. This can be effected for example by means of a piston plate spring 92 or via an elastomeric damping element 90*a*, in connection with which attention is directed to FIG. 12A. FIG. 12B shows a variant with which the piston plate 90, sprung for example via a piston plate spring 92 or an elastomeric layer 90*b*, is directly acted upon by the gas force.

Figure 13A:
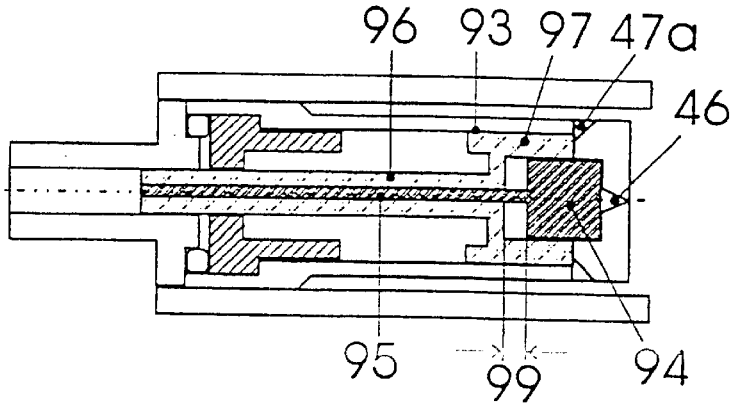
FIGS. 13A to 13B two apparatuses having tandem systems, with which the working piston contains a secondary piston.
Figure 13B:
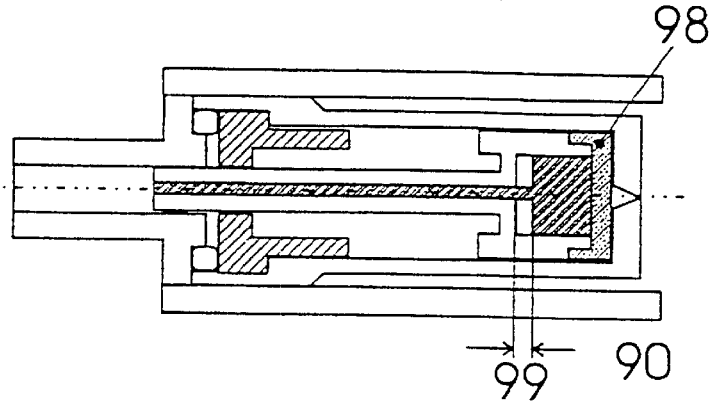

FIGS. 13A and 13B relate to a configuration of the new apparatus for highly specialized uses. There is here involved a tandem system having a working piston plate 97 in which there is located a further piston or secondary piston 94. In accordance with FIG. 13A there runs the secondary piston 94 which has a piston rod 95 associated therewith, which is arranged in the piston shaft 96 of the outer working piston. In this example, the secondary piston 94 and the outer working piston can be separately driven, for example via a media supply 46 for the secondary piston 94 and a media supply 47*a* for the outer working piston, in connection with which attention is directed to FIG. 4A.

In the example of the FIG. 13A the inner piston 94 moves in a rearward piston sleeve closed by means of a lid 98.

In the apparatuses which are illustrated in FIGS. 13A and 13B, the piston rod 95 of the secondary piston 94 can carry out a movement over a distance 99 relative to the piston shaft 96 of the working piston. Therewith it is for example possible to initiate a particular auxiliary function in a correspondingly configured fastening element or bolt.

With the exemplary embodiments of the new apparatuses illustrated up to now, it is assumed that the drive of the working piston is effected via a drive fluid, for example a pyrotechnically generated gas. As already mentioned, along with this generally usual drive by means of gas force, other further drive possibilities come into consideration. Particularly interesting thereby is, certainly, electromagnetic acceleration. The possibility of employing such means is sketched out in the following, that is without circuitry and current supplies, appropriate fundamentals being available in the CCG course of Sterzelmeier.

Basically, so-called coil accelerators come into consideration here, which work in pulsed manner with temporally limited induction. With the application under discussion here, a so-called flat coil accelerator primarily comes into consideration, such as is known from electrodynamics. The principle, based on Lenz's rule, consists as is known in that a current pulse is directed through an electrically well conducting ring, which is magnetically coupled with a coil. The two parts thereby repel each other with great force. The principle can be employed both for ring-shaped and also plane elements. Thereby there can be distinguished between:

- coil systems in the piston sleeve or ring accelerator;
- coil systems in the piston plate or flat coil accelerator;
- electromagnetic braking device.

A particular advantage of electrical devices is in the control. Thus, for example, the energy can be set corresponding to the necessary emplacement power. Due to the very short signal transfer times, there is even possible a control/regulation during the emplacement procedure itself.

Figure 14A:
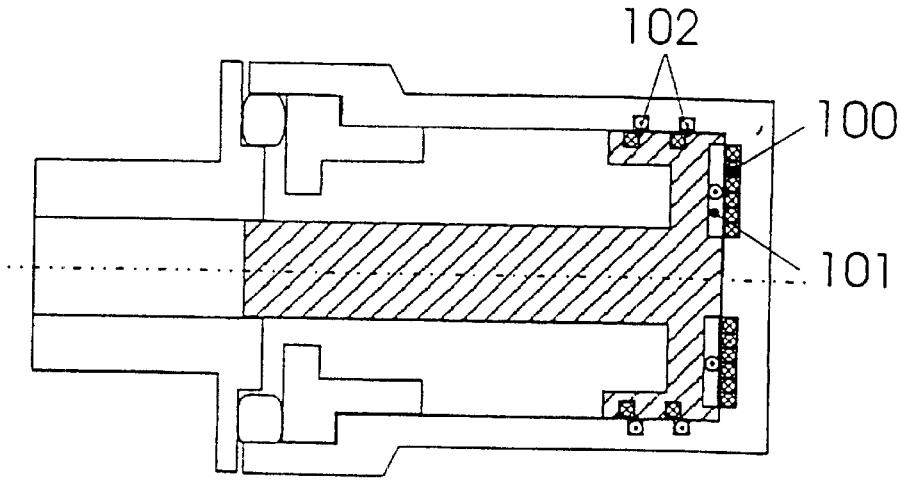
FIG. 14A and FIG. 14B apparatuses with electromagnetic drive of the working piston.

In FIG. 14A, two possibilities are illustrated. A primary coil 100 accelerates a secondary coil 101 in the floor of the piston plate. Alternatively, or parallel thereto, the working piston may also be driven via a radial coil system 102.

Figure 14B:
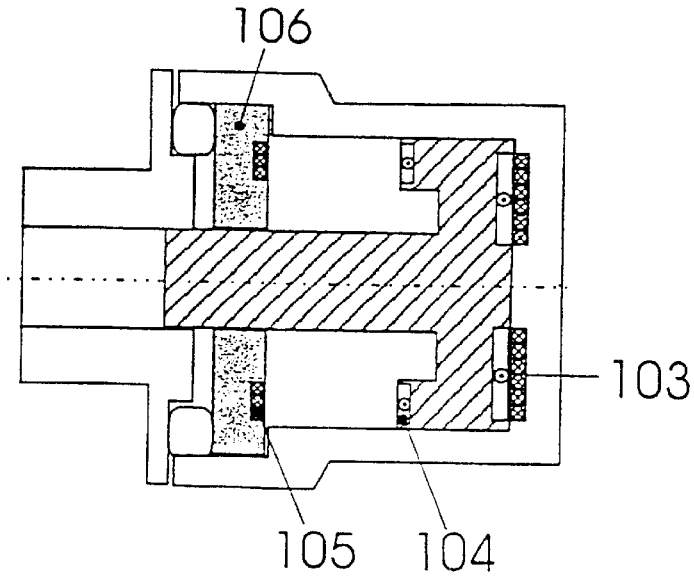

It is also possible to effect the return of the working piston via corresponding coil systems 103 and 104 with the secondary coil 105, accommodated in a ring 107 in connection with which attention is directed to FIG. 14B.

Fundamentally, an axial drive with axially shorter, rather preferably laterally more extended systems, is to be recommended. Because, on the one hand, the efficiency increases with larger coil systems, and on the other hand with higher accelerations greater radial forces must be taken up by the material surrounding the coils.

I claim:

1. An apparatus for the emplacement of a fastening element (4) into a placement base (6), comprising a working piston for acting on the fastening element (4) upon emplacement, said piston including a piston plate (11, 34) and a piston shaft (34) constituted of a rigid, non-deformable material, a piston guide sleeve (7), said piston plate (11, 51) being displaceable within said piston guide sleeve (7) during a working stroke (31) from a rest position into an end position, said piston plate having in a working direction a ring-shaped stop surface (37) having arranged coaxially therewith and at a spacing therefrom a ring-shaped countersurface (43) on a receiving sleeve (38, 50) which is constituted of a rigid, non-deformable material;

characterized in that said stop surface (37) comprises an end surface of a sleeve (35) on the piston plate (11) concentrically surrounding the piston rod (34), said counter-surface (43) being formed by an end surface of the receiving sleeve (38, 39, 50) which is fixedly arranged on the piston guide sleeve (7), said stop surface (37) and the counter-surface (43), in said rest position, being distanced from each other by an axial length corresponding to the length of said working stroke (31), said receiving sleeve (38, 39, 50) and counter-surface (43) in conjunction with the sleeve (35) on the piston plate (11) comprising a spring chamber (44), which is arranged in a ring-shape around the piston shaft (34) of the working piston, said spring chamber having an axially rigidly fixed length in the working direction defined by the stop surface (37) and the counter-surface (43), a return device (8, 52, 53*a*, 53*b*, 54*a*, 54*b*, 55*a*, 57, 77) being arranged, in said spring chamber for returning the working piston (11, 34, 51) from the end position into the rest position.

2. An apparatus according to claim 1, wherein said piston shaft (34) and said piston plate (11, 51 are constituted of a single piece.

3. An apparatus according to claim 1, wherein said piston shaft (34) and said piston plate (11, 51) are formed from separate components.

4. An apparatus as claimed in claim 1, wherein the stop surface (37) is formed by the ring surface on said piston plate (51).

5. An apparatus according to claim 1, wherein the piston shaft (34), the piston plate (11, 51), the piston sleeve (35) and the sleeve (39, 50) and the receiving sleeve (38) are selected from the group of materials consisting of heavy metal, steel, light metals comprising duraluminum and titanium, ceramics material, a fiber composite material, a hammered or cold hardened metallic material, and a multi-gradient material which is cast, machined, forged or drawn.

6. An apparatus according to claim 1, wherein said the piston sleeve (35) and the receiving sleeve (38, 51) each comprise web-like surface portions which are arranged centrally symmetrically to the longitudinal axis of the working piston (34, 11).

7. An apparatus according to claim 1, wherein the stop surface (37) and the counter-surface (43), relative to the longitudinal axis of the 25 working piston (34,11), extend selectively at right angles and conically.

8. An apparatus according to claim 1, wherein drive means are provided for the drive of the working piston (11, 34, 51), said drive means being selectively constituted of mechanical, chemical/pyrotechnical, pressurized fluid, electromagnetic or electrothermal drive means.

9. An apparatus according to claim 1, wherein said piston shaft (34) includes, at a forward surface thereof, a stamping or punching device or a receiver part providing for contact with the fastening element (4).

10. An apparatus according to claim 1, wherein said piston shaft (34) comprises selectively a hollow or solid stamping tool, a forward region of the piston shaft (34) differing in diameter or shape from a rearward region thereof.

11. An apparatus according to claim 1, wherein said piston shaft (34) includes a bore, a central cylindrical core and a shaft sleeve surrounding said core, and is variable in diameter and length, and in cross-section.

12. An apparatus according to claim 8, wherein said piston plate (11) is selectively flat on a side towards the drive means, or has a recess on at least one side, includes a device for media supply and for media distribution on the side of the drive means.

13. An apparatus according to claim 1, wherein said piston plate (11) has an element set into a bore (67).

14. An apparatus according to claim 1, wherein said piston plate (11) is sealed, by a ring (49*a*) or a labyrinth seal (49*b*) relative to a media chamber (46).

15. An apparatus according to claim 1, wherein said piston shaft (34) and said piston plate (11) are selectively interconnected by threads, soldering, gluing, vulcanization, clamping or shrink-fit, friction welding, or at oppositely located contact surfaces, metallically through sintering or bonding.

16. An apparatus according to claim 1, wherein said working piston (3) is braked by elastomeric buffer, a metallic element, a friction clamping, a spring element or ring element, said element being cylindrical on at least one side and having a recess on at least one side thereof.

17. An apparatus according to claim 1, wherein said ring element or the receiving sleeve has an outer web and/or an inner web.

18. An apparatus according to claim 1, wherein said supply of working fluid is provided centrally or eccentrically via feeds distributed about the periphery of said piston.

19. An apparatus according to claim 1, wherein said return device (8) comprises a rubber sleeve (52), a hollow-chamber rubber system (53*a*), a spring bellows (53*b*) constituted of a metal or polymer, a rubber spring (54*a*), a spiral spring (55*a*), a flat wire spring (55*b*) or multi-part or multi-stage spring elements (57), possessing a guide (57*c*).

20. An apparatus according to claim 1, wherein said piston plate (11) comprises a stepped plate (60) having a forward piston plate portion and a rearward piston plate portion, the drive being effected via at least one of said two stepped portions.

21. An apparatus according to claim 20, wherein the stepped portions of the stepped plate (60) are constituted of either the same homogeneous material or from different materials, and are selectively connected by soldering, welding, screwing, vulcanization, or metallically at mated contact surfaces thereof through sintering or bonding.

22. An apparatus according to claim 1, wherein a mass-altering ring element (77) is connected with the piston shaft (73) or with the piston plate (78), said ring element possessing spring properties and bearing directly on the receiving sleeve (79).

23. An apparatus according to claim 1, wherein said working piston (97) contains internally a secondary piston (94), the working piston (97) and the secondary piston (94) being jointly driven, and said secondary piston being movable in either an open or closed system.

24. An apparatus according to claim 1, wherein a damping element (92) is located between said piston shaft (34) and said piston plate (90).

25. An apparatus according to claim 1, wherein at least two piston shafts are fastened in the piston plate (11).

26. An apparatus according to claim 1, wherein a damping element (92) is arranged between the piston plate (90) and a piston plate cover (90*a*), said damping element (92), comprising a metallic spring or an elastomeric element.

27. The use of the apparatus according claim 1, for fastening a component (5) on the surface of a placement base (6) by a fastening element characterized in that the component (5) is located to the surface of the placement base (6), upon aratus being deployed into a firing position with the shaft guide sleeve (16) on the component, the working piston (3) being in its rest position, and with the working piston (3) being driven until reaching the end position thereof so as to thereby emplace the fastening element (4) through the component (5) into the placement base (6).

* * * * *